US005233272A

United States Patent [19]

Whang et al.

[11] Patent Number: 5,233,272

[45] Date of Patent: Aug. 3, 1993

[54] DC PLASMA DISPLAY PANEL AND DRIVING METHOD THEREOF

[75] Inventors: Ki-woong Whang; Kyung-cheol Choi, both of Seoul, Rep. of Korea

[73] Assignee: Samsung Electron Devices, Co., Ltd., Kyunggi, Rep. of Korea

[21] Appl. No.: 867,521

[22] Filed: Apr. 13, 1992

[30] Foreign Application Priority Data

Aug. 30, 1991 [KR] Rep. of Korea ..... 91-15144[U]

[51] Int. Cl.[5] ..... H05B 41/00; G09G 3/10

[52] U.S. Cl. ..... 315/168; 315/169.4

[58] Field of Search ..... 315/169.1, 169.4, 167, 315/168; 313/583, 582, 584, 585, 586, 587; 340/718, 719, 789, 794, 805, 811, 812, 813

[56] References Cited

U.S. PATENT DOCUMENTS 4,081,715 3/1978 Uemura ..... 315/167 X
4,654,649 3/1987 Kojima et al. ..... 315/169.4 X
5,124,615 6/1992 Kim ..... 313/584 X

OTHER PUBLICATIONS

"A 33-in. Diagonal HDTV Display Using Gas Discharge Pulse Memory Technology" by Hiroshi Murakami et al., SID 91 Digest 713-716.

*Primary Examiner*—David Mis
*Attorney, Agent, or Firm*—Leydig, Voit & Mayer

[57] ABSTRACT

A plasma display panel and driving method thereof is disclosed which has an electrical field disturbing means for disturbing and distorting a discharge region in a discharge cell between an anode and cathode. The disturbing means is formed with an auxiliary electrode, thereby having a floating effect on particles in a main discharge region.

8 Claims, 7 Drawing Sheets

DC PLASMA DISPLAY PANEL AND DRIVING METHOD THEREOF

BACKGROUND OF THE INVENTION

The present invention relates to a DC plasma display panel (PDP) and driving method thereof, and more particularly to a double-pulse-memory (DPM) type DC PDP and driving method thereof which has high luminance, high discharge efficiency and improved response.

As developments in the field of HDTV continue, some outcomes have been obtained. As the developments proceed further, the importance of the picture display medium (or picture display device) has increased. Display devices such as color CRT's, liquid crystal displays (LCD), electroluminous (EL) flat panel displays a fluorescent displays, PDP's and the like, are expected to dominate the area of main display devices for a considerable period henceforth. However, in connection with the development of HDTVs, there is no one satisfactory display of yet, and they are mutual complements of one another.

Among such displays, the PDP is suitable for a large-size picture and becomes a most promising display in this field, because it is thin in spite of its large size and has high luminance and resolution as well as high contrast ratio.

Generally, according to a discharging method and depending upon its structure, a PDP is divided into DC and AC types. These types are further subdivided into memory and non-memory types. One category of DC memory type PDP's is studied and manufactured in the NHK Institute of Japan. This PDP incorporates a planar pulse memory (PPM) and uses a DC pulse voltage so that it has a memory function itself and supplies prime charged particles before a main discharge.

However, the PPM type PDP does not meet HDTV requirements in luminance, discharge efficiency and contrast ratio, and still needs further study. Notably, one of greatest defects in this PDP is its considerable power consumption as compared with other displays. This is due to a high driving voltage and supply of prime particles for controlling addressing time. Further, a pressing problem to be solved for PDPs is efficiency. The low efficiency of PDP's is disadvantageous in competing against other displays.

To overcome the problems, various aspects of PDPs have been studied; particularly in the areas of physical structure improvement and electrode material development. For instance, as an improvement of luminance, in a color PDP, the distance between electrodes is extended to obtain sufficient ultraviolet radiation. As an improvement of discharge efficiency, the cathode structure may be improved or its material may be changed to enhance the discharge efficiency of secondary electrons. Particularly in an auxiliary discharge type PDP, in order to efficiently produce charged particles and simultaneously utilize the produced charged particles, the structures of electrodes and their peripheral elements are improved. Meanwhile, the improvement in contrast ratio mainly pertains to the auxiliary discharge types, wherein the electrode array is altered to block auxiliary discharge light from being seen in front.

All the above studies on PDP's have proven to be unsatisfactory and, therefore, an adequate PDP has not been developed yet.

The present invention provides a PDP having improved discharge characteristics.

SUMMARY OF THE INVENTION

Therefore, it is an object of the present invention to provide a PDP and driving method which has a low discharge voltage and a high luminance due to a high discharge efficiency under an allowed discharge voltage.

To accomplish this object, the plasma display panel of the present invention comprises front and rear plates having a discharge space therebetween filled with discharge gas, striped first electrodes formed on both or either of the front and rear plates, striped second electrodes formed on either of the front and rear plates, perpendicular to the first electrodes and spaced apart therefrom by a predetermined distance, parallel barriers provided at intersections of the first and second electrodes for preventing crosstalk between cells, and a diffuser placed adjacent to a discharge path between the first and second electrodes for disturbing or diffusing periodically or irregularly the movement of charged particles due to the discharge between the first and second electrodes so as to extend the path of the charged particles.

In a method of driving a plasma display panel comprising a cell formed in a pattern with cathode and anode between front and rear plates filled with discharge gas therebetween and an auxiliary electrode provided around said cell, a first DC voltage pulse having a predetermined potential and period is applied to the cathode and anode constituting the cell, and a second DC voltage pulse having a frequency higher than and a potential lower than those of the first DC pulse, is applied to the auxiliary electrode.

In the PDP of the present invention, the diffuser is formed in parallel and spaced apart from the first and second electrodes. It is composed of a striped auxiliary electrode to which a high frequency DC pulse is applied and is therefore functionally called a diffusing electrode or disturbing electrode.

While discharge occurs by maintaining the discharge potential of the first and second electrodes a DC pulse of a predetermined period is applied to the auxiliary electrode so that the flow of gas ions and charged particles moving between the electrodes is disturbed and diffused by a local electric field formed by the auxiliary electrode. Here, a DC pulse of a certain period for main discharge (indicating discharge) is applied to the first and second electrodes, and a DC pulse having a shorter period than that of the main discharge DC pulse is applied to the auxiliary electrode. The applied voltage maintains a potential high enough so as not to create a discharge between the first and second electrodes, and if required, may maintain a potential which creates some priming particles.

In the PDP of the present invention, the flow of ions and electrons between the electrodes takes place in wave form, not in a straight line, due to the local disturbing electrical field by the diffuser, so that the particles can be held in the discharge space for a long time.

Due to this, secondary electrons are produced abundantly to reduce the minimum discharge sustaining voltage during main discharge and the remaining abundant charged particles can be used for a subsequent discharge or afterglow. In other words, the diffused priming particles remain until the afterglow to help the main discharge so that discharge delay at the start of indicating discharge is improved for better response. Accordingly, under the same conditions as the conventional one, the PDP of the present invention has a lower discharge voltage to consume less power, as well as faster response and higher luminance, than the conventional PDP.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Figure 1:
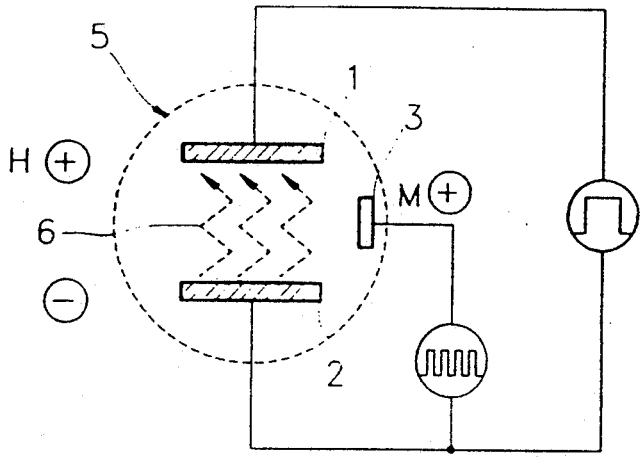
FIG. 1 illustrates a structural concept of a PDP cell according to the present invention.
Figure 2:
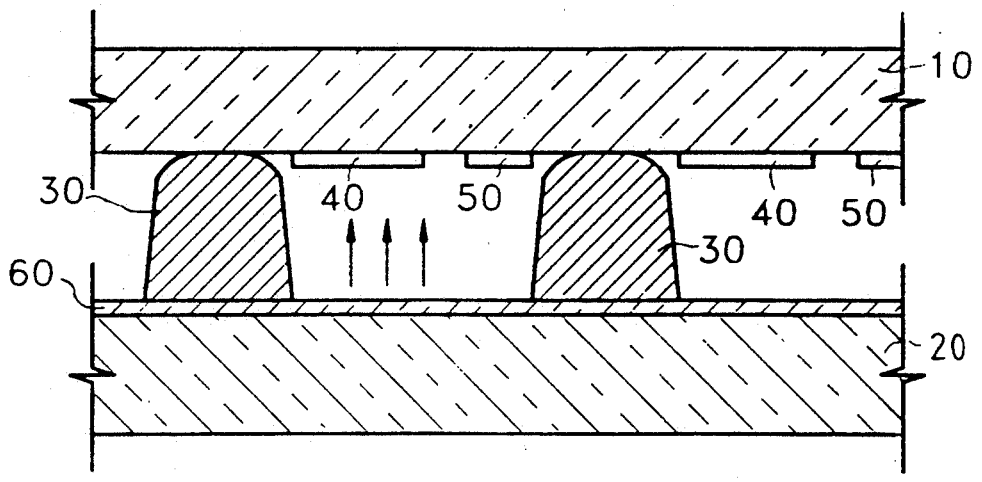
FIGS. 2 and 3 are schematic cross-sectional views of embodiments of PDP according to the present invention.

FIG. 1 illustrates a concept of a unit discharge cell according to the PDP of the present invention, and FIG. 2 illustrates a schematic cross-sectional view of the PDP according to the present invention.

Referring to FIG. 1, the basic concept of the PDP of the present invention will be described.

An anode 1 (which, hereinafter, will sometimes be referred to as a main electrode) and a cathode 2 oppose each other in a unit discharge cell 5 filled with discharge gas. As a feature of the present invention, an auxiliary electrode 3 as a disturbing and diffusing electrode is provided around the discharge region between the anode and cathode. A relatively low frequency DC pulse is applied to anode 1 and cathode 2 and a relatively high frequency positive DC pulse is applied to auxiliary electrode 3. Here, the voltage applied to auxiliary electrode 3 has a potential such that the relative potential difference between anode 1 and cathode 2 does not create a discharge however, if required, brings about some prime effect.

In the cell having such a structure and such a voltage application method, space insulation is broken by the electric field formed between anode 1 and cathode 2 to begin discharge. If the potential of auxiliary electrode 3 is zero (grounded), charged particles move in a straight line through the shortest path.

However, at this time, if a high frequency DC pulse of medium potential is applied to auxiliary electrode 3, the electrical field between anode 1 and cathode 2 is periodically distorted due to a periodic or aperiodic disturbing electric field formed by the applied pulse. Due to this, charged particles passing through an equipotential line between anode 1 and cathode 2, as shown in FIG. 1, are diffused in the form of wave 6 because of the distortion of the equipotential line.

The above discharge method, in effect, results in extending the proceeding distance of the charged particles in a limited cell 5, that is, a limited discharge space. The elongation of the proceeding distance of charged particles means that the floating time of charged particles in the discharge space is elongated. This accelerates the production of more secondary electrons to improve luminance, and makes the diffused, charged particles remain until a subsequent afterglow period, to facilitate forming an afterglow.

Now, embodiments of the present invention based upon the above concept will be described in detail.

Referring to FIG. 2, being similar to a conventional one, the PDP of the present invention has a front plate 10 and a rear plate 20, interposing a plurality of parallel barriers 30. Striped anodes 40 as a first electrode are formed alternately with barriers 30 in the same direction thereof. An auxiliary electrode 50 as a disturbing and diffusing electrode is provided between anode 40 and barrier 30 so that a pair of anode 40 and auxiliary electrode 50 is provided between barriers 30. Striped cathodes 60 as a second electrode are formed on rear plate 20, perpendicular to anodes 40.

Figure 4:
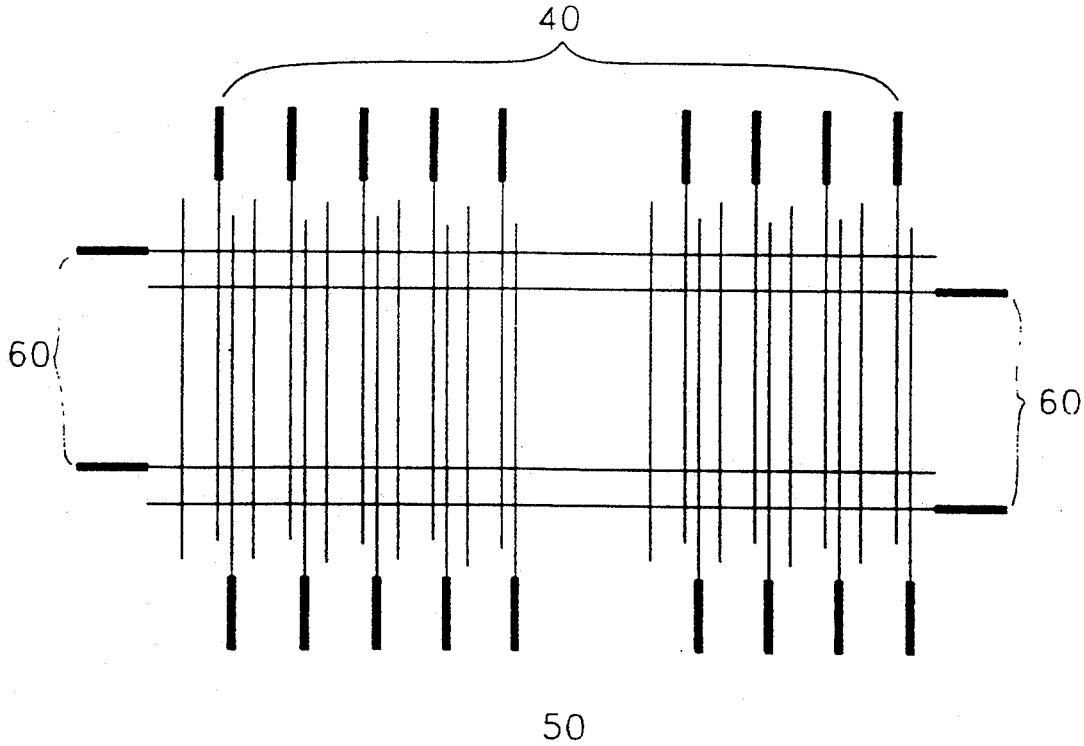
FIG. 4 illustrates an electrode array of the PDP according to the present invention.

The PDP has an electrode array shown in FIG. 4 and, for a practical application, is manufactured according to a following table.

TABLE

| | height (mm) | width (μm) | planar resistance (Ω/area) |
|---|---|---|---|
| cathode | 12 | 240 | 0.3 |
| anode | 8 | 180 | 0.952 |
| auxiliary electrode | 8 | 180 | 0.831 |
| barrier | 50 | 280 | |
| discharge gas | | Ne + Ar 0.1% Penning gas | |
| vacuum | | 500 Torr | |
| pixel number | | 64 × 40 | |
| cell pitch | | 1 mm | |

Figure 3:
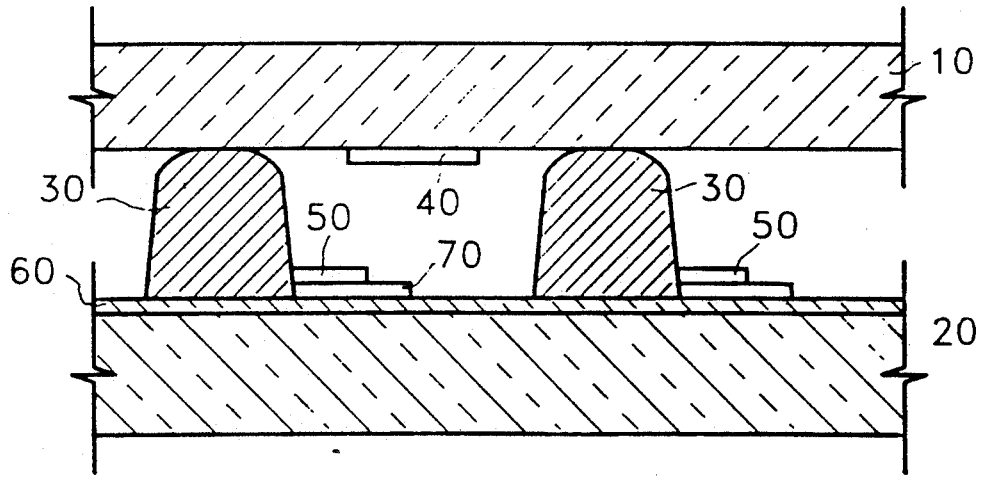

Here, for example, a nickel paste (a Dupont product known as 9535) is used as the anode and cathode, while a silver paste (Dupont's 77131) is used for the terminals of the respective electrodes. The specific construction of the anode and cathode is to show one embodiment and may be modified in various forms based upon the basic concept of the present invention. For example, as shown in FIG. 3, the position of auxiliary electrode 50 may be changed such that it is placed above the cathode on rear plate 20, interposing an insulator 70 and being perpendicular to the cathode. Furthermore, taking a planar discharging method, all the electrodes may be placed on the rear plate. Meanwhile, even though a positive potential DC pulse is supposed to be applied to the auxiliary electrode, a negative potential voltage may be applied. However, the proceeding disturbance and diffusion of charged particles should be performed by the electric field of the auxiliary electrode.

The characteristics of the PDP of the present invention are measured with inspecting equipment, and the results will be described with reference to FIGS. 5 to 14.

Figure 5:
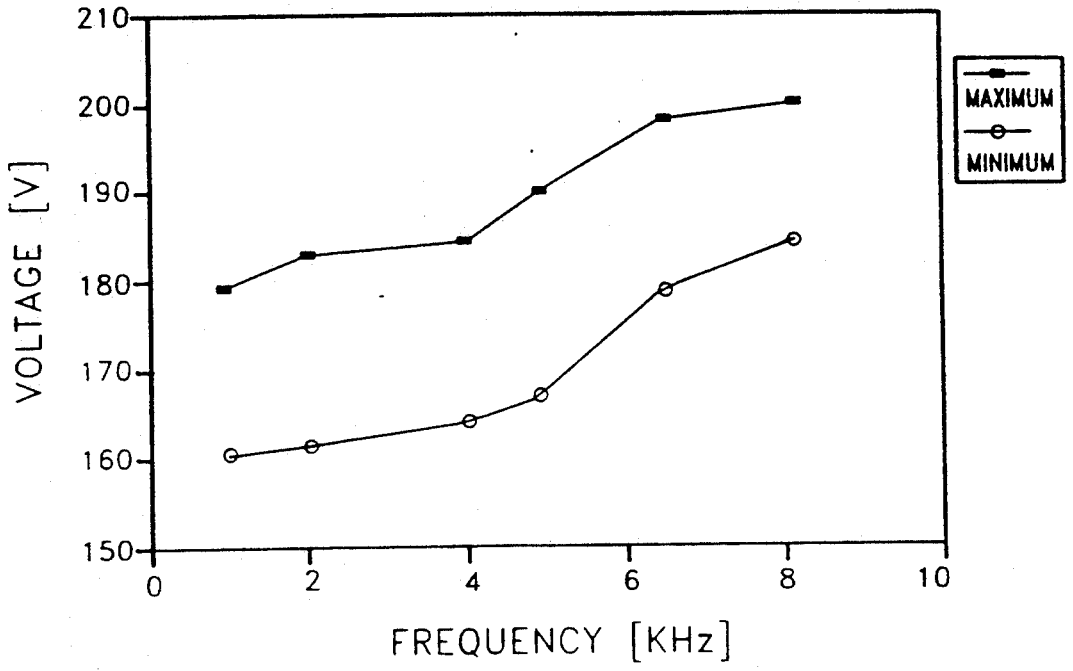
FIGS. 5 and 7-14 show characteristics of the PDP of the present invention depending on various conditions.

FIG. 5 shows the variation of discharge firing voltage and minimum discharge sustaining voltage according to the variation of the main discharge pulse, that is, a possible glow-discharge region. In FIG. 5, experimentally, a voltage is not applied to an auxiliary electrode, and as frequency increases, discharge voltage increases. The discharge region, that is, the voltage range between the discharge firing voltage and sustaining voltage is a region in which a pulse for memory function stably works. As the region gets larger, the pulse works more stably. However, a discharge maximum sustaining voltage, that is, the discharge firing voltage, has a limit in efficiency, while a discharge minimum voltage is influenced by the discharge environment. Thus, it is more practical that discharge sustaining voltage is reduced to increase the region where the pulse works.

Figure 6:
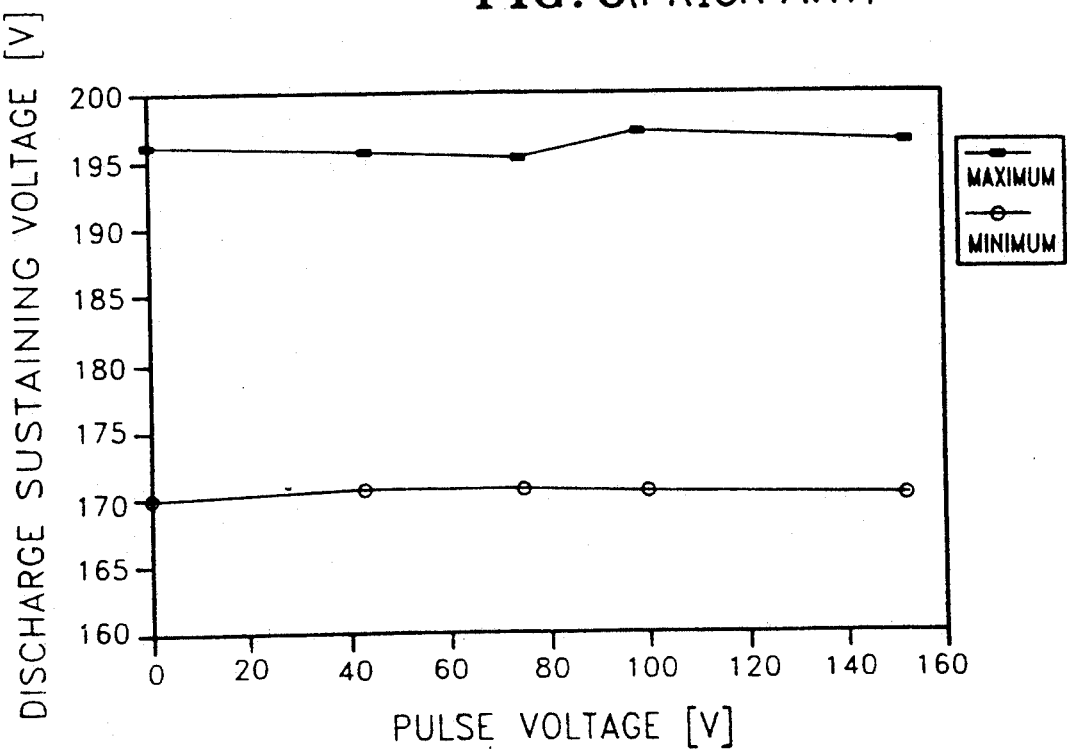
FIG. 6(PRIOR ART)
FIG. 6 shows characteristics of a conventional PDP for comparison with the PDP of the present invention.

FIG. 6 shows a pulse working region in which, for main discharge, a DC pulse of 1 KHz is applied and a simple DC voltage is applied to the auxiliary electrode. This case corresponds to the PPM driving method of the NHK Institute. Priming particles are produced and supplied by the auxiliary discharge but, in practice, the minimum sustaining voltage cannot vary, as shown in the FIG. 6.

Figure 7:
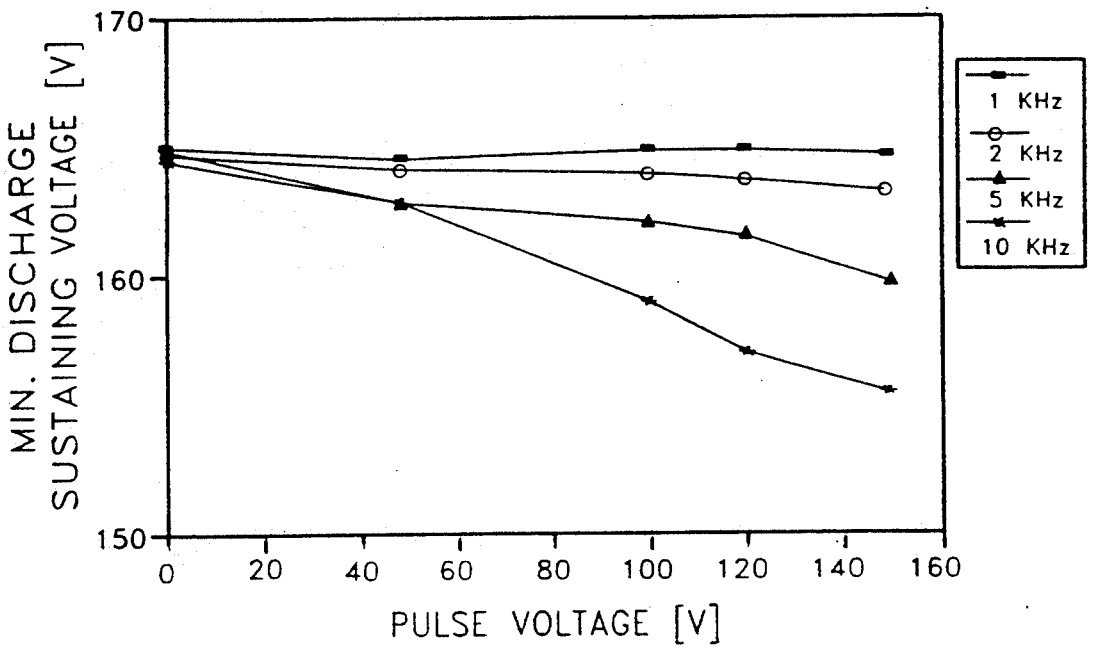

In FIG. 7, there is shown the variation of the discharge sustaining minimum voltage according to the variation of the pulse frequency and peak voltage of the auxiliary electrode in the DPM method of the present invention, that is, respective independent DC pulses are applied to the anode and auxiliary electrode.

As known from the above, in the case when the pulse applied for main discharge is lower than or equal to the pulse applied to the auxiliary electrode, the minimum sustaining voltage remains almost unvaried, and if the frequency of the pulse to the auxiliary electrode is gradually raised, the discharge sustaining minimum voltage is gradually reduced. Here, if the voltage of the pulse applied to the auxiliary electrode is maximized, the minimum discharge sustaining voltage is further reduced due to the rising effect. As a result, if a DC pulse having a frequency higher than that applied to the anode is applied to the auxiliary electrode, the minimum discharge sustaining voltage is reduced. However, in the opposite case from the above, the minimum discharge sustaining voltage is not reduced.

Figure 8:
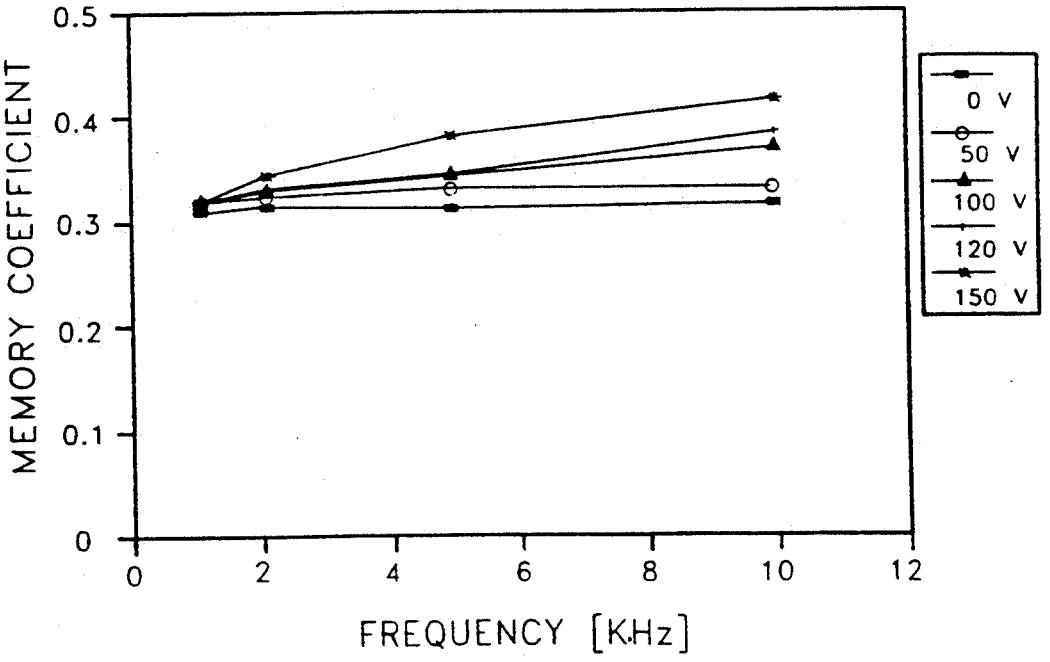

FIG. 8 shows the variation of a memory coefficient versus frequency variation. This shows that an increase in frequency brings about an increase in the memory coefficient.

Figure 9:
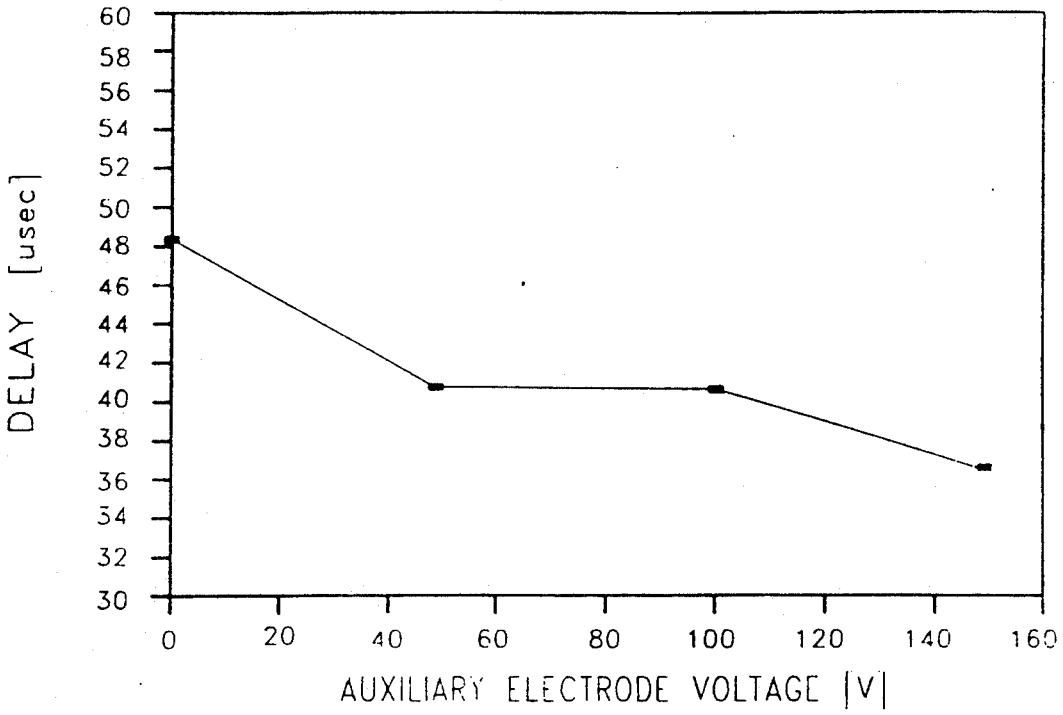

Meanwhile, the effect of a DC pulse applied to the auxiliary electrode on a delay time for determining the addressing time when driving a PDP, is examined. FIG. 9 shows the delay time variation over the auxiliary electrode's voltage variation when a pulse having a 1 ms period is applied to accomplish main discharge and pulse having a 0.12 ms period is applied to the auxiliary electrode, which indicates that an increase of the auxiliary electrode voltage brings about a great reduction in delay time.

Figure 10:
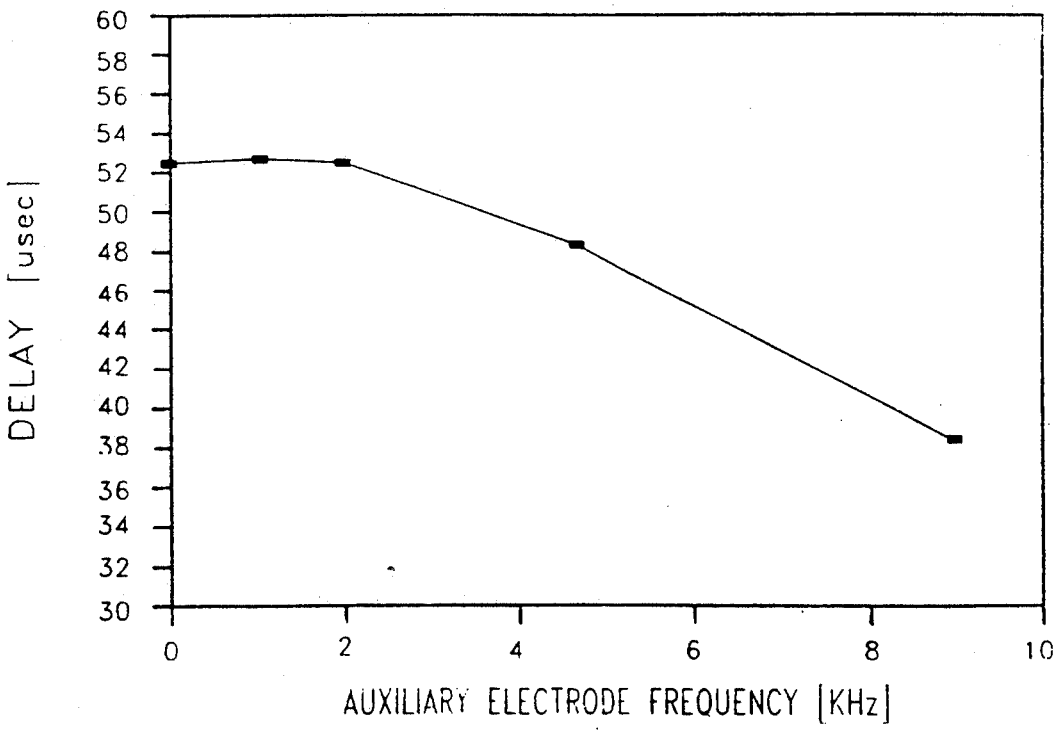

FIG. 10 shows the variation of delay time according to DC pulse frequency when the DC pulse voltage of the auxiliary electrode is fixed at 150 V. This shows that as the frequency of the DC pulse to the auxiliary electrode increases, that is, the frequency of a DC pulse applied between the main electrode (anode) and cathode is higher, delay time is shortened.

As described above, the PDP of the present invention takes a discharging method having a different concept from the conventional PDP. In the conventional PDP, priming particles created in adjacent electrodes play a role in reducing the delay time. However, in the PDP of the present invention, the auxiliary electrode improves the delay time by controlling its charged particles (self-priming) as well as by controlling main discharge glow to play the role of external charged particles.

Figure 11:
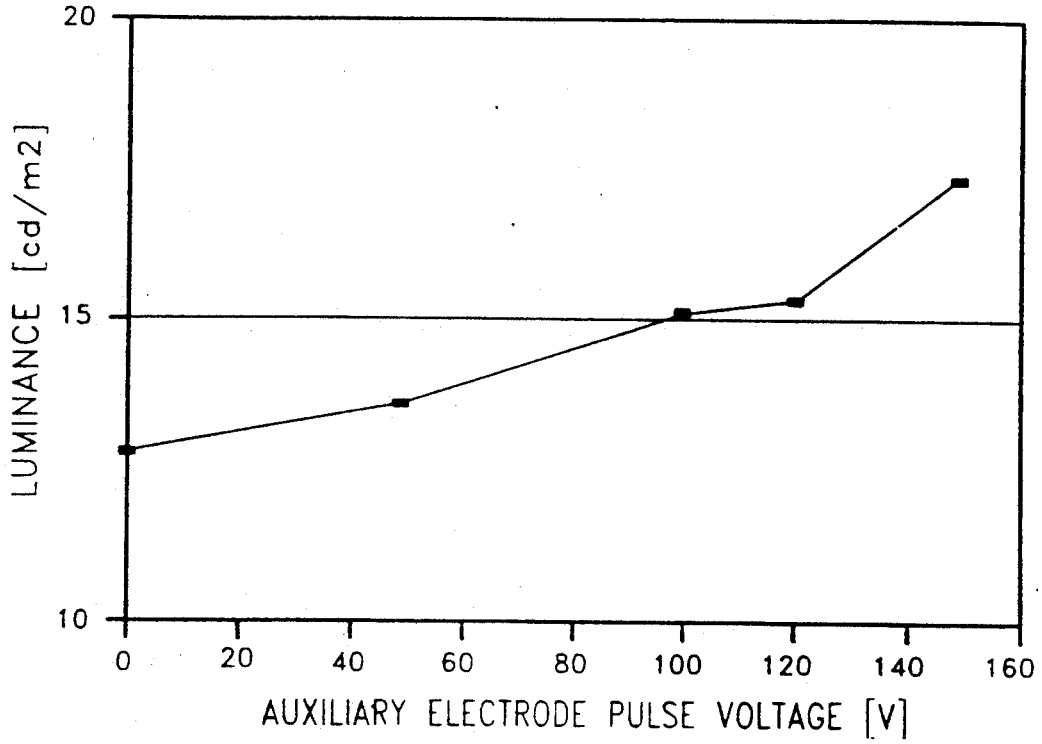
Figure 12:
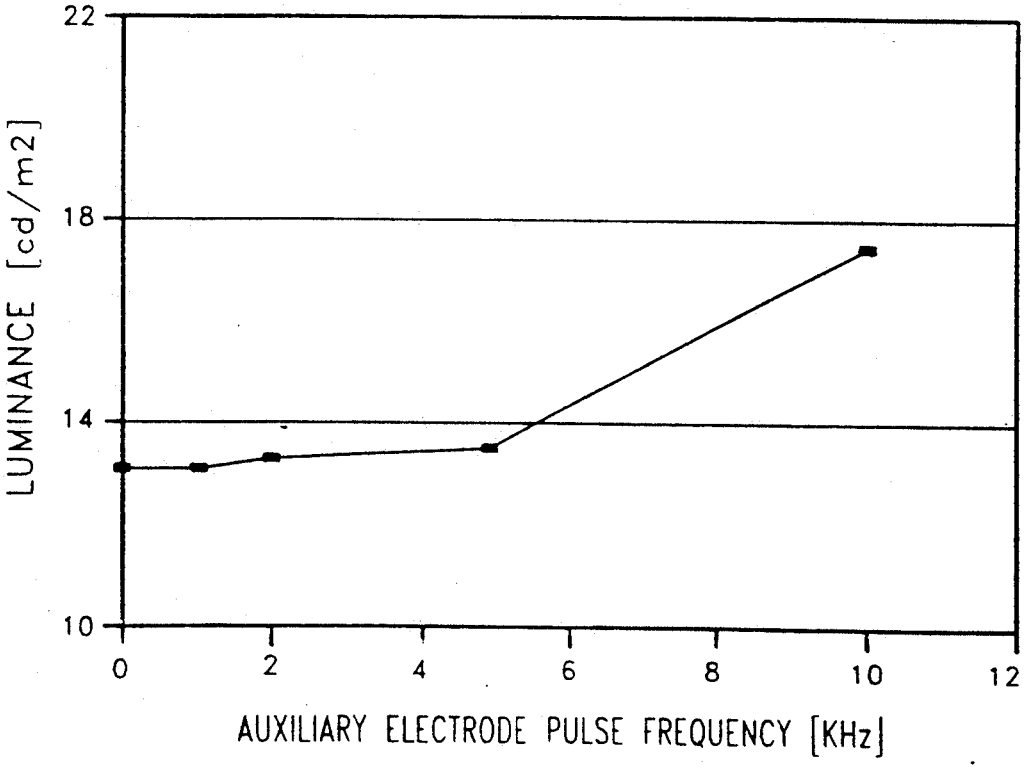

Meanwhile, FIGS. 11 and 12 show the results of the relative luminance of a pixel. FIG. 11 illustrates luminance due to a DC pulse having a 1 ms period to the main electrode (anode) according to the variation of DC pulse voltage when the DC pulse to the auxiliary electrode has a period of 1 ms. In FIG. 11, as the voltage of the DC pulse increases, luminance increases.

FIG. 12 shows the result of varying the frequency of the DC pulse to the auxiliary electrode while fixing its at 150 V, and indicates that an increase in frequency results in increased luminance. Further, in FIG. 12, it is shown that luminance can be controlled by appropriately adjusting the diffusion of charged particles and afterglow, according to the variation the frequency and voltage of the DC pulse to the auxiliary electrode. That is, the control of particle diffusion and afterglow can improve pixel luminance. The improvement of pixel luminance enables the enhancement of the gray scale without changing the duty ratio of the main discharge pulse or the pixel current. Besides the luminance improvement, the PDP of the present invention can also improve luminance efficiency by controlling the delay time regardless of priming particles.

Figure 13:
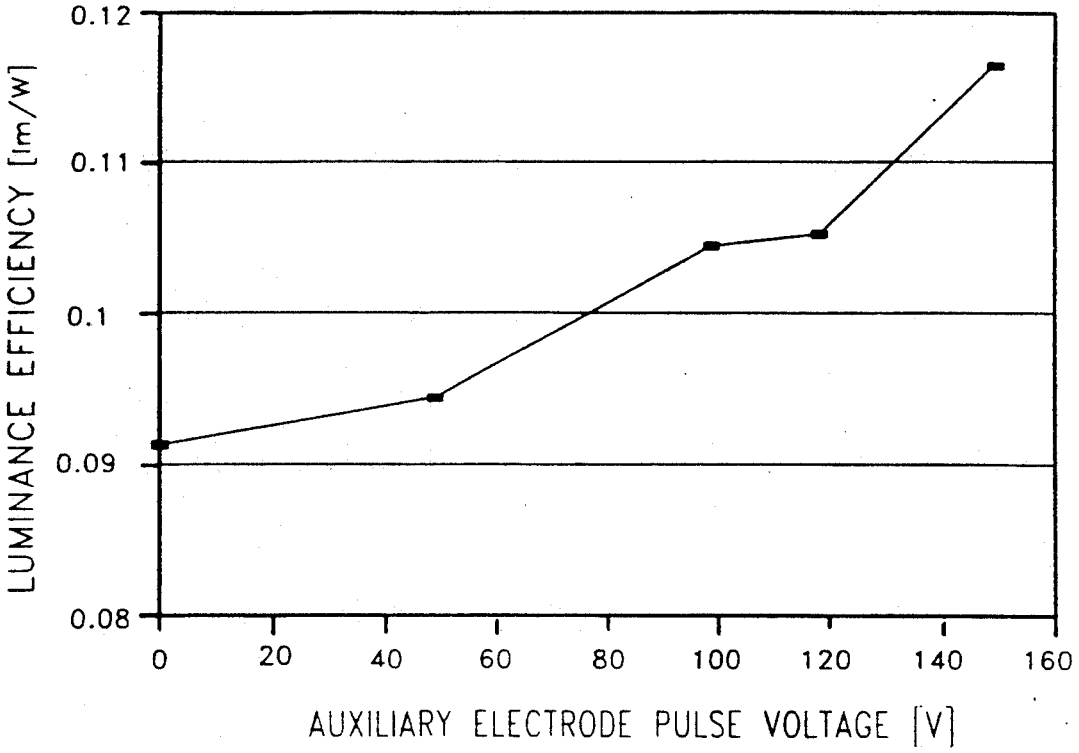
Figure 14:
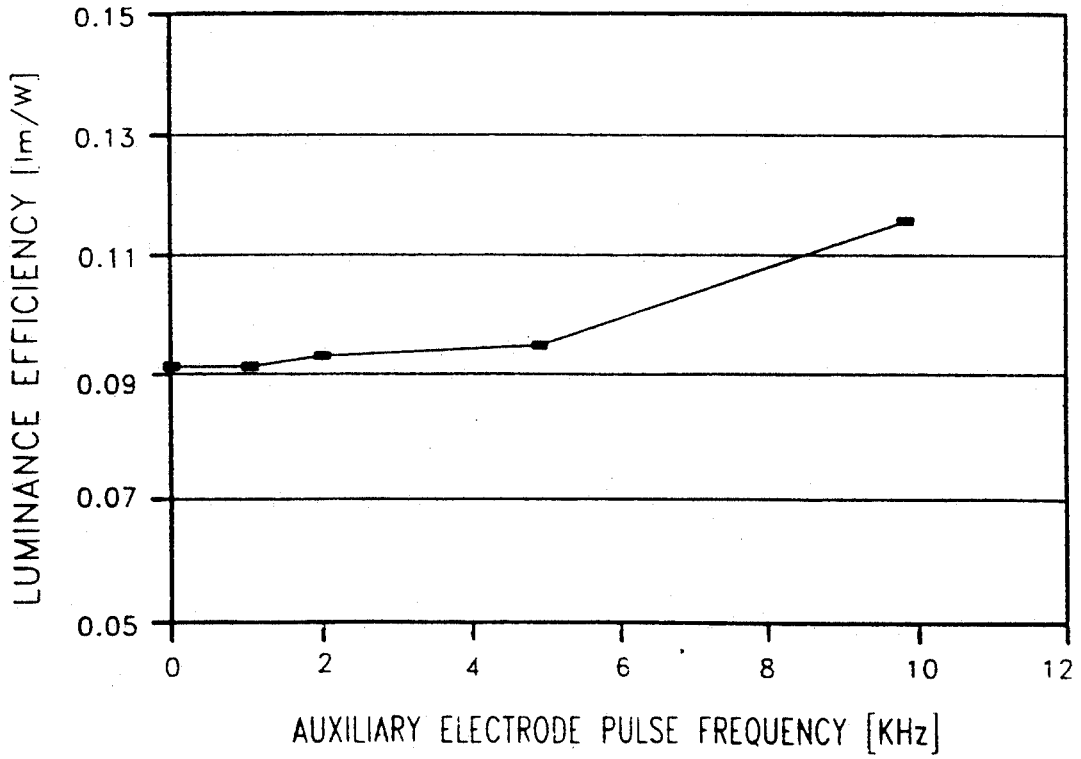

FIGS. 13 and 14 show results of cell efficiency according to the DPM method of the present invention. FIG. 13 shows the improvement of cell efficiency according to the pulse voltage variation of the auxiliary electrode. FIG. 14 shows the improvement of cell efficiency over the auxiliary electrode's pulse frequency. In other words, the control of the diffusion of charged particles and afterglow with the pulse to the auxiliary electrode leads to the improvement in efficiency. Even if a little more power is consumed when applying the pulse to the auxiliary electrode, the overall efficiency increases when the luminance improvement is taken into account. Further, since the DPM method of the present invention drives the PDP without a supply of priming particles and with a shortened delay time, this method is much more efficient than the PPM method.

As described above in detail, the PDP of the present invention is superior to the conventional PPM PDP in memory capacity, delay time, luminance and efficiency. The basic principle is, as mentioned before, to change the plasma properties by controlling the diffusion of charged particles and that of afterglow both of which are due to discharge. The present invention is not confined to any specific structure. In other words, any PDP having a diffusing means for forming an electrical field diffused around a main discharge region is included in the scope of the present invention. In short, in the present invention, a pulse working region for a memory function increases according to the increase of voltage and frequency of the pulse to an auxiliary electrode. Further, a reduced delay time enables faster addressing, while the increase of the pulse voltage and frequency applied to the auxiliary electrode leads to pixel luminance improvement to facilitate control of the gray scale. This provides excellent efficiency compared with conventional PDPs.

What is claimed is:

1. A plasma display panel comprising:

front and rear plates having a discharge space therebetween filled with discharge gas;

striped first electrodes formed on said front plate;

striped second electrodes formed on said rear plate, perpendicular to said first electrodes and spaced apart therefrom by a predetermined distance;

a plurality of parallel barriers, each barrier sandwiched between said front and rear plates and positioned between adjacent striped first electrodes for preventing crosstalk, wherein adjacent barriers form discharge spaces with said front and rear plates; and a plurality of diffusing means, each diffusing means placed adjacent to a discharge path between said first and second electrodes for periodically or aperiodically disturbing the movement of charged particles due to the discharge between said first and second electrodes, so as to extend the path of charged particles.

2. A plasma display panel as claimed in claim 1, wherein said diffusing means is an auxiliary electrode which is disposed in parallel with one of said first and second electrodes and to which a voltage pulse having a higher frequency than that of a DC pulse applied to either end of said first and second electrodes, is applied to disturb and distort an electrical field between said first and second electrodes, so as to diffuse charged particles produced from the disturbance and distortion.

3. A plasma display panel as claimed in claim 2, wherein said first electrodes and auxiliary electrode are formed on said front plate in parallel with each other.

4. A plasma display panel as claimed in claim 2, wherein said second electrodes are formed on said rear plate and said auxiliary electrode is formed on said second electrodes, interposing an insulator and being perpendicular to said second electrodes.

5. A plasma display panel as claimed in claim 4, wherein said first electrodes are formed on said front plate, perpendicular to said second electrodes.

6. A method of driving a plasma display panel having a plurality of discharge spaces, each discharge space defined by a front plate, a rear plate and a pair of adjacent barrier ribs and each discharge space having an auxiliary electrode disposed therein, the method comprising the steps of:

applying a first DC voltage pulse having a first frequency and a first potential to the anode and the cathode; and applying a second DC voltage pulse to the auxiliary electrode having a second frequency which is greater than the first frequency and having a second potential which is lower than the first potential.

7. A method of driving a plasma display panel as claimed in claim 6, wherein the voltage applied to said auxiliary electrode has the maximum potential that does not create a discharge with said cathode.

8. A method of driving a plasma display panel having a plurality of discharge spaces, each discharge space defined by a front plate, a rear plate and a pair of adjacent barrier ribs and each discharge space having an auxiliary electrode disposed therein, the method comprising the steps of:

applying a first DC voltage pulse having a first frequency and a first potential to the anode and the cathode to cause charged particles to be discharged along a discharge path between the anode and the cathode; and applying a second DC voltage pulse to the auxiliary electrode having a second frequency which is greater than the first frequency and having a second potential which is sufficient to alter the discharge path of the charged particles without causing discharge between the auxiliary electrode and the anode.

* * * * *